US010578260B1

(12) United States Patent
Chen

(10) Patent No.: US 10,578,260 B1
(45) Date of Patent: Mar. 3, 2020

(54) DECORATIVE SCULPTURES WITH LED-BASED LIGHTING SYSTEMS

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 198 days.

(21) Appl. No.: 15/860,887

(22) Filed: Jan. 3, 2018

Related U.S. Application Data

(60) Provisional application No. 62/441,900, filed on Jan. 3, 2017, provisional application No. 62/466,547, filed on Mar. 3, 2017, provisional application No. 62/477,159, filed on Mar. 27, 2017.

(51) Int. Cl.

| | |
|---|---|
| ***F21S 4/26*** | (2016.01) |
| ***F21V 33/00*** | (2006.01) |
| ***F21V 21/002*** | (2006.01) |
| ***A47G 33/08*** | (2006.01) |

(52) U.S. Cl.
CPC ..... *F21S 4/26* (2016.01); *A47G 33/08* (2013.01); *F21V 21/002* (2013.01); *F21V 33/008* (2013.01); *A47G 2033/0827* (2013.01)

(58) Field of Classification Search
CPC ... F21S 4/26; A47G 33/08; A47G 2033/0827; F21V 33/008; F21V 21/002
See application file for complete search history.

(56) References Cited

U.S. PATENT DOCUMENTS

| | | | |
|---|---|---|---|
| 4,761,720 | A | 8/1988 | Solow |
| 4,812,956 | A | 3/1989 | Chen |
| 6,086,221 | A | 7/2000 | Wu |
| 6,582,094 | B2 | 6/2003 | Liu |
| 6,592,238 | B2 | 7/2003 | Cleaver et al. |
| 6,604,841 | B2 | 8/2003 | Liu |
| 6,758,001 | B1 | 7/2004 | Su |
| 6,769,954 | B2 | 8/2004 | Su |
| 6,914,194 | B2 | 7/2005 | Fan |
| 7,088,904 | B2 | 8/2006 | Ryan, Jr. |
| 7,160,140 | B1 | 1/2007 | Mrakovich et al. |

(Continued)

FOREIGN PATENT DOCUMENTS

| | | | |
|---|---|---|---|
| CN | 200982547 | Y | 11/2007 |
| CN | 201121811 | Y | 9/2008 |

(Continued)

*Primary Examiner* — Sonji N Johnson
(74) *Attorney, Agent, or Firm* — Christensen, Fonder, Dardi & Herbert PLLC

(57) ABSTRACT

A lighted decorative sculpture. The sculpture includes detachable sections that extend sequentially along an axis and may include detachable sections that extend laterally from the axis. A main power circuit including wires of a first gauge extends through the sculpture, and may include excess length between the detachable sections to enable separation of the detachable sections without stressing the wiring. Light strings electrically connected to the main power circuit distribute lighting to each of the detachable sections. The light strings include parallel wires that are of a second gauge, the second gauge being higher (lighter) than the first gauge. The lights may be light emitting diodes (LEDs). The lights may be oriented to emit a maximum intensity in a direction that is substantially parallel to the parallel wires to provide a distribution of light about the light string.

20 Claims, 12 Drawing Sheets

(56) References Cited

U.S. PATENT DOCUMENTS

| | | | | |
|---|---|---|---|---|
| 7,661,847 | B2 | 2/2010 | Wang | |
| D623,084 | S | 9/2010 | Chen et al. | |
| 7,926,978 | B2 | 4/2011 | Tsai | |
| 8,397,381 | B2 | 3/2013 | Tsai | |
| 8,641,229 | B2 | 2/2014 | Li | |
| 9,291,318 | B1 | 3/2016 | Benson | |
| 2003/0063463 | A1 | 4/2003 | Sloan et al. | |
| 2004/0246718 | A1 | 12/2004 | Fan | |
| 2005/0047136 | A1 | 3/2005 | Fan | |
| 2006/0158878 | A1 | 7/2006 | Howell | |
| 2006/0221609 | A1 | 10/2006 | Ryan, Jr. | |
| 2008/0094828 | A1 | 4/2008 | Shao | |
| 2010/0001664 | A1 | 1/2010 | Shih | |
| 2011/0228535 | A1 | 9/2011 | Shao | |
| 2013/0107514 | A1 | 5/2013 | McNabb et al. | |
| 2016/0341408 | A1 | 11/2016 | Altamura | |
| 2017/0010033 | A1* | 1/2017 | Garcia | A63H 33/001 |
| 2017/0328527 | A1 | 11/2017 | Yang et al. | |

FOREIGN PATENT DOCUMENTS

| | | | |
|---|---|---|---|
| CN | 201897194 | U | 7/2011 |
| CN | 201898147 | U | 7/2011 |
| CN | 201966240 | U | 9/2011 |
| CN | 202613183 | U | 12/2012 |
| CN | 203703878 | U | 7/2014 |
| GB | 2 454 546 | A | 5/2009 |

* cited by examiner

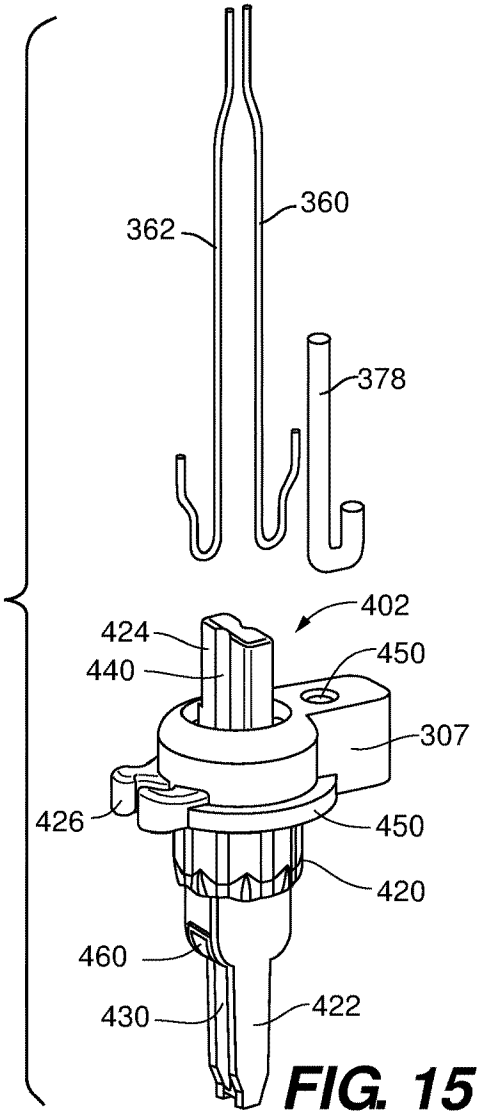
FIG. 15
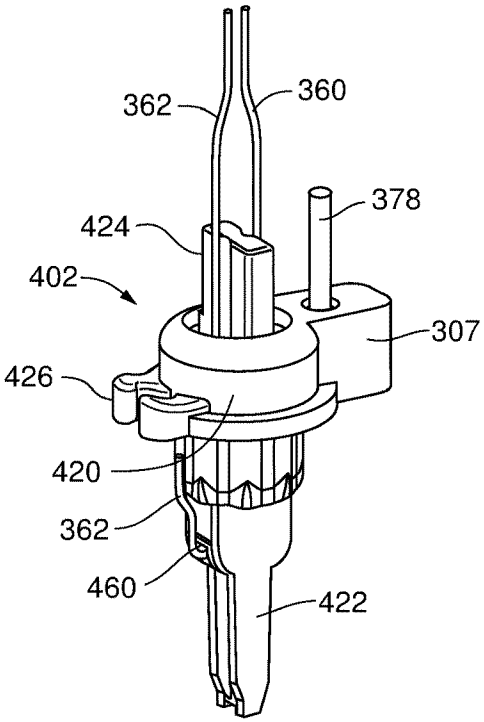
FIG. 16
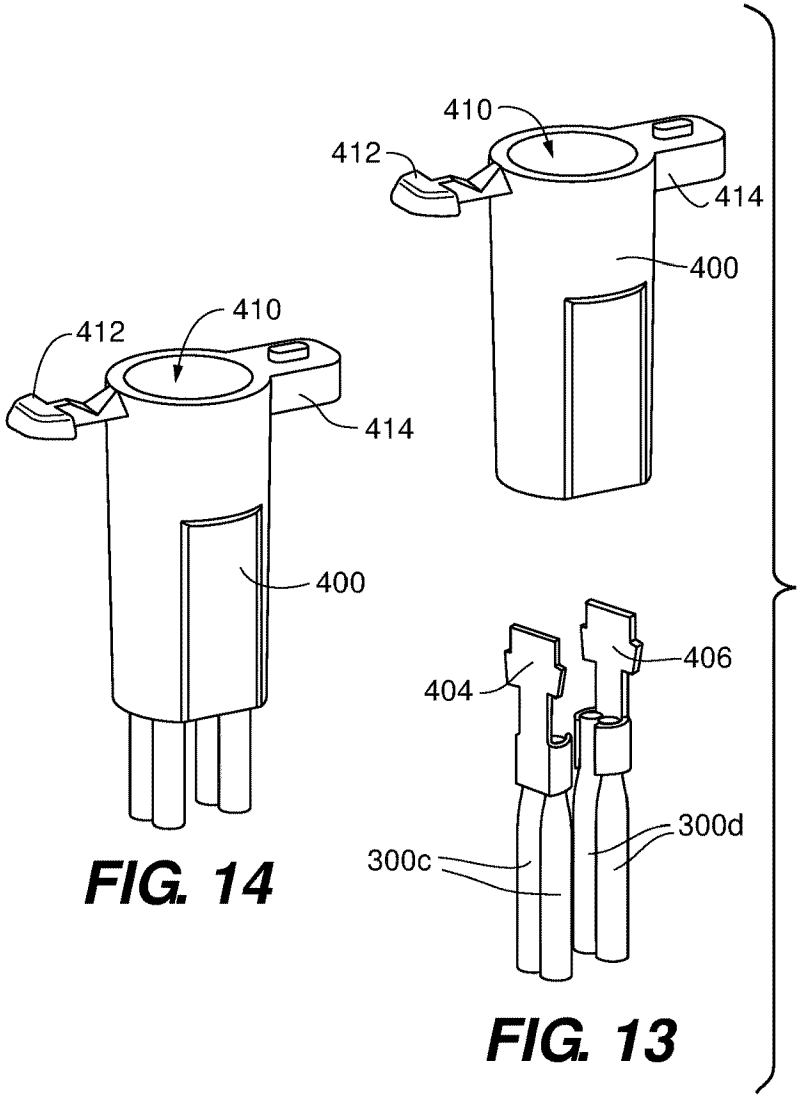
FIG. 13
FIG. 14

DECORATIVE SCULPTURES WITH LED-BASED LIGHTING SYSTEMS

RELATED APPLICATIONS

This application claims the benefit of U.S. Provisional Patent Application No. 62/441,900 entitled "Decorative Sculptures with LED-Based Lighting Systems", filed Jan. 3, 2017, and U.S. Provisional Patent Application No. 62/466,547, entitled "Refractive Decorative Lighting String," filed Mar. 3, 2017, and U.S. Provisional Patent Application No. 62/477,159, entitled "Lighted Decorative Sculpture," filed Mar. 27, 2017, the disclosures of which are incorporated by reference herein in their entireties.

FIELD OF THE DISCLOSURE

The present disclosure relates to decorative lighting systems. More specifically, the present disclosure relates to decorative sculptures with light-emitting-diode-based lighting and wiring systems.

BACKGROUND OF THE DISCLOSURE

Traditional lighted decorative sculptures typically include components that are mechanically affixed to each other to represent a figure in three dimensions, such as a reindeer, Santa Claus, snowman, stable, or similar holiday figure. Often, these sculptures are situated outdoors, and exposed to inclement weather. Light strings are attached to the sculptures to outline the sculpture for illumination in darkness. Traditional light strings typically include a set of insulated wires and incandescent bulbs. The insulated wires typically comprise a pair of insulated multi-strand conductors, for example, a pair of 22 AWG insulated wires, each multi-strand conductor having sixteen twisted copper strands, connected to each bulb. The gauge of the wire must be sufficient to withstand the rigors of shipping, handling, and storage, as well as the extremes of outdoor weather, such as snow, rain, and a substantially wide range of temperatures.

More recently, and in an effort to increase energy efficiency and reliability, manufacturers have begun using light-emitting diodes (LEDs) rather than incandescent bulbs. Indeed, lighted decorative sculptures having light strings with LEDs rather than incandescent bulbs are well known. Such known lighted decorative sculptures often simply replace the incandescent bulbs with similar bulb or lamp assemblies that use LED "bulbs," utilizing the same insulated, multi-strand conductor wiring as the incandescent-bulb-based light strings, and utilizing the same techniques of affixing the light strings to the sculpture. In some cases, the lower current requirements of the LEDs may allow the use of smaller diameter conductors or fewer conductor strands, for example, allowing the use of 25 AWG wire, for example, instead of 22 AWG wire. While such a technique maintains the look and feel of a traditional lighted decorative sculptures having traditional light strings, with the growing popularity of more and more lights on a decorative sculpture, such sculptures, even with LED technology, include an enormous length of insulated wire that remains visible on the components of the lighted decorative sculpture, thereby diminishing the perceived attractiveness of the sculpture. Further, shipping, handling, and storage considerations require the use of relatively strong, traditional wires having conductor thicknesses that may be oversized given the low current draw of LEDs.

A simple and inexpensive solution that takes full advantage of the low-current requirements of LED lamps while maintaining the integrity of the lighting system would be welcomed.

SUMMARY

Various embodiments of the disclosure include a lighted decorative sculpture with a lighting system that has a main power circuit of heavier gauge wires that can be flexed when assembling or disassembling the detachable sections of the lighted decorative sculpture, with light strings that extend or branch from the main power circuit of lighter gauge wires that remain relatively stationary during assembly and disassembly. In some embodiments, the main power circuit includes excess lengths (e.g., "pigtails") to enable the sculpture components sections to be detached and arranged, for example, for shipping or storage within a container. The excess lengths enable the assembly, disassembly, shipping, and storage of the components of the lighted decorative sculpture without imparting excessive stress on the main power circuit, the light strings, or the structure of the sculpture. The heavier gauge of the main power circuit enables the main power circuit to be flexed during assembly and disassembly of the lighted decorative sculpture without being damaged, while the lighter gauge wires of the light strings remain immobile and substantially free of flexing, protected within the detachable sections.

In some embodiments, the light strings utilize light emitting diodes (LEDs) that are oriented so that the emitted light is distributed about a longitudinal axis of the light string. The LEDs are oriented so that a maximum intensity of the light emitted is substantially parallel along a longitudinal axis of the light string. The distributed emission of light about the longitudinal axis will tend to make the lighting effect of the lighting strings more uniform, regardless of the direction from which the lighted decorative sculpture is viewed. The distributed emission is in contrast to the conventional orientation of the LEDs, which emit light strongly in one lateral direction away from the light string.

Structurally, a lighted decorative sculpture is disclosed, comprising a plurality of detachable sections, each including an open framework that defines a component of the lighted decorative structure, and a light string of light emitting diodes (LEDs) attached to the open framework, the light string including wires that are connected to the LEDs such that all or groups of LEDs are electrically connected to one another in parallel, the wires being of a first gauge. A main power circuit passes through each of the plurality of detachable sections, the main power circuit including parallel wires of a second gauge, the second gauge being higher than the first gauge. In some embodiments, the first gauge is in a range of 24 AWG to 30 AWG inclusive, and the second gauge is in a range of 18 AWG to 22 AWG inclusive. The parallel wires of the light string of LEDs may be multi-strand wires.

The parallel wires of each of the light string of LEDs of each of the plurality of detachable section are connected to the parallel wires of the main power circuit. In some embodiments, the lighted decorative sculpture does not include a light string that branches from another light string. The light string of LEDs of each of the plurality of detachable sections is attached to the open framework at anchoring locations along the light string of LEDs. The light string of LEDs may be connected to the main power circuit with a connector. In various embodiments, the light string of LEDs is replaceable.

In some embodiments, the main power circuit includes excessive length that permits the plurality of detachable sections to be detached and arranged for storage or shipping. The excess length may be disposed within the lighted decorative sculpture when the plurality of detachable sections are attached. In some embodiments, each of the plurality of detachable sections is three-dimensional. In some embodiments, the LEDs of the light string of LEDs are oriented to direct a maximum intensity of light emitted from the LEDs in a direction substantially parallel to the parallel wires of the light string of LEDs.

In various embodiments of the disclosure, a light string is disclosed, comprising a pair of parallel wires defining a longitudinal axis that extends parallel to and between the pair of parallel wires. An electrically insulative material is disposed over a first section and a second section of the pair of parallel wires, the first section and the second section being separated from each other along the longitudinal axis of the parallel wires to define a first end of the first section and a second end of the second section, the first end being opposed to the second end. A light emitting diode (LED) electrically bridges the pair of parallel wires, the LED being disposed between the first end of the first section and the second end of the second section, the LED being oriented to direct a maximum intensity of light emitted from the LEDs in a direction substantially parallel to the parallel axis. In some embodiments, the LED, the first end, the second end, and the pair of parallel wires that extend from the first end to the second end are encapsulated in a translucent material. The parallel wires may be of a gauge that is in a range of 24 AWG to 30 AWG inclusive. In one embodiment, the pair of parallel wires of the light string are multi-strand wires.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

FIGS. 12-21 depict an alternative connector system in an embodiment of the disclosure.

DETAILED DESCRIPTION

Figure 1:
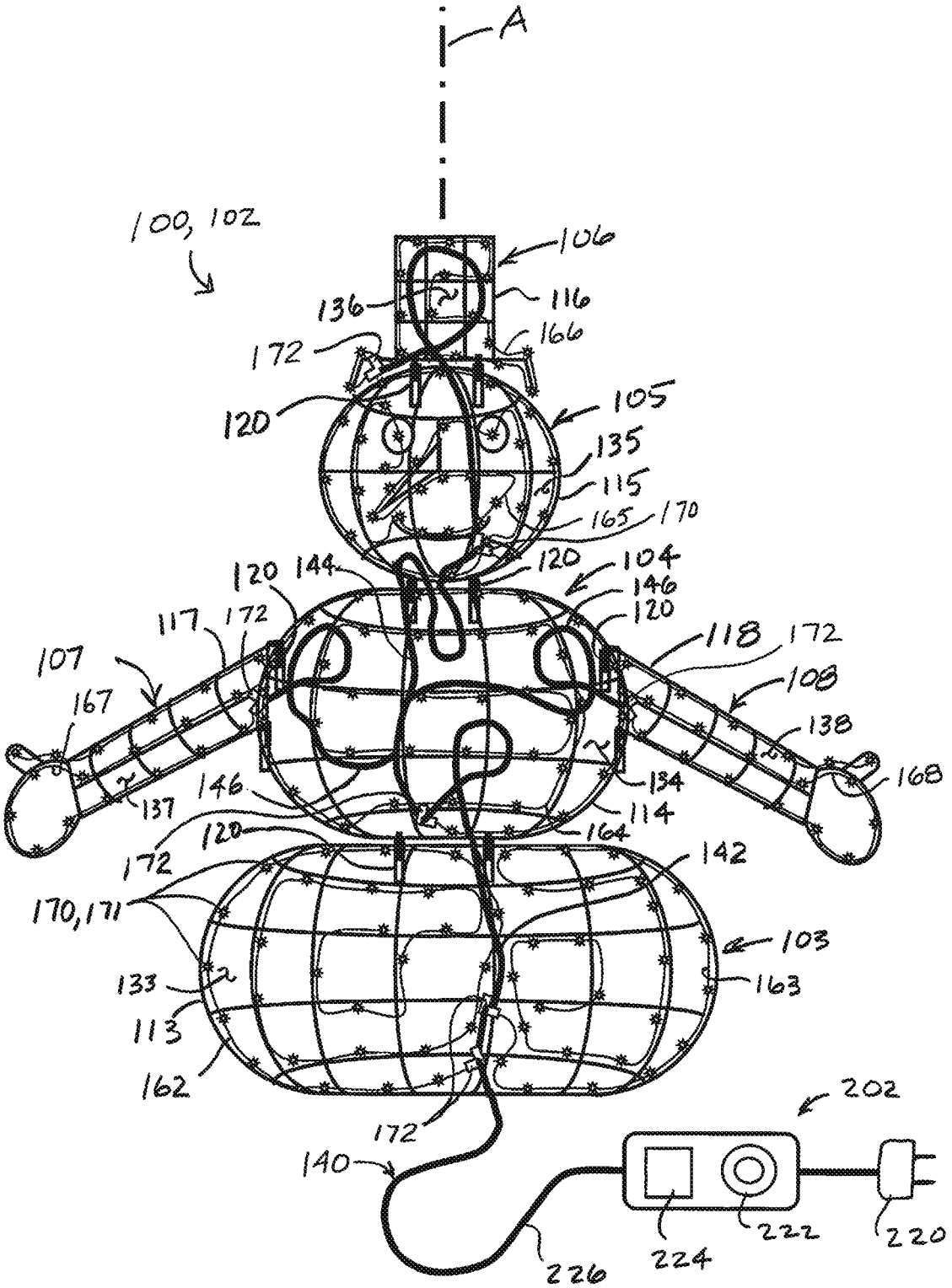
FIG. 1 is an elevational view of a fully assembled lighted decorative sculpture in an embodiment of the disclosure.

Referring to FIG. 1, an embodiment of a lighted decorative sculpture 100 with a light emitting diode (LED)-based lighting system is depicted in an embodiment of the disclosure. In the depicted embodiment, the lighted decorative sculpture 100 includes detachable sections 103, 104, 105, 106, 107, and 108. In the depicted embodiments, the detachable sections 103-108 define a snowman 102, with detachable sections 103-106 being arranged vertically along a central axis A, and with detachable sections 107 and 108 extending lateral to the central axis A. It is understood that, generally, lighted decorative sculpture 100 may define a sculpture other than the snowman 102, for example, a reindeer, Santa Claus, stable, or other figure that includes detachable components. Such sculptures may include more or fewer detachable sections than depicted. Also, the axis A is depicted as straight and vertical for the snowman 102. More generally, the axis A is characterized as extending through components of a sculpture that are connected in sequence, such as the sections 103-106 of the snowman 102, with other components extending laterally from the axis A, such as the sections 107 and 108 of the snowman 102. Each tree section includes a plurality of lights 170, such as light-emitting-diodes (LEDs) 171, as will be described further below.

Figure 2:
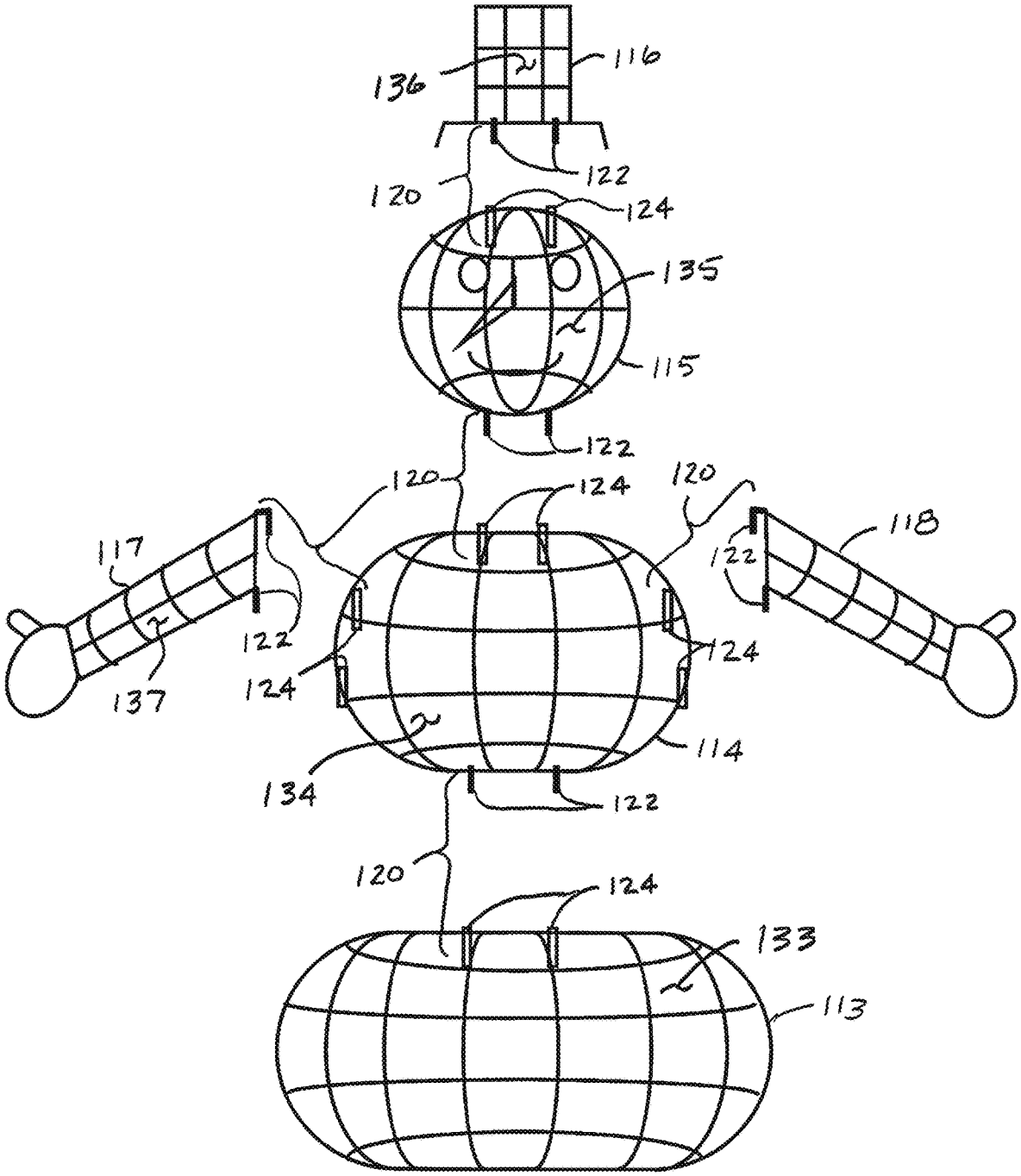
FIG. 2 is an exploded view of open frameworks of the lighted decorative sculpture of FIG. 1 in an embodiment of the disclosure.
Figure 3:
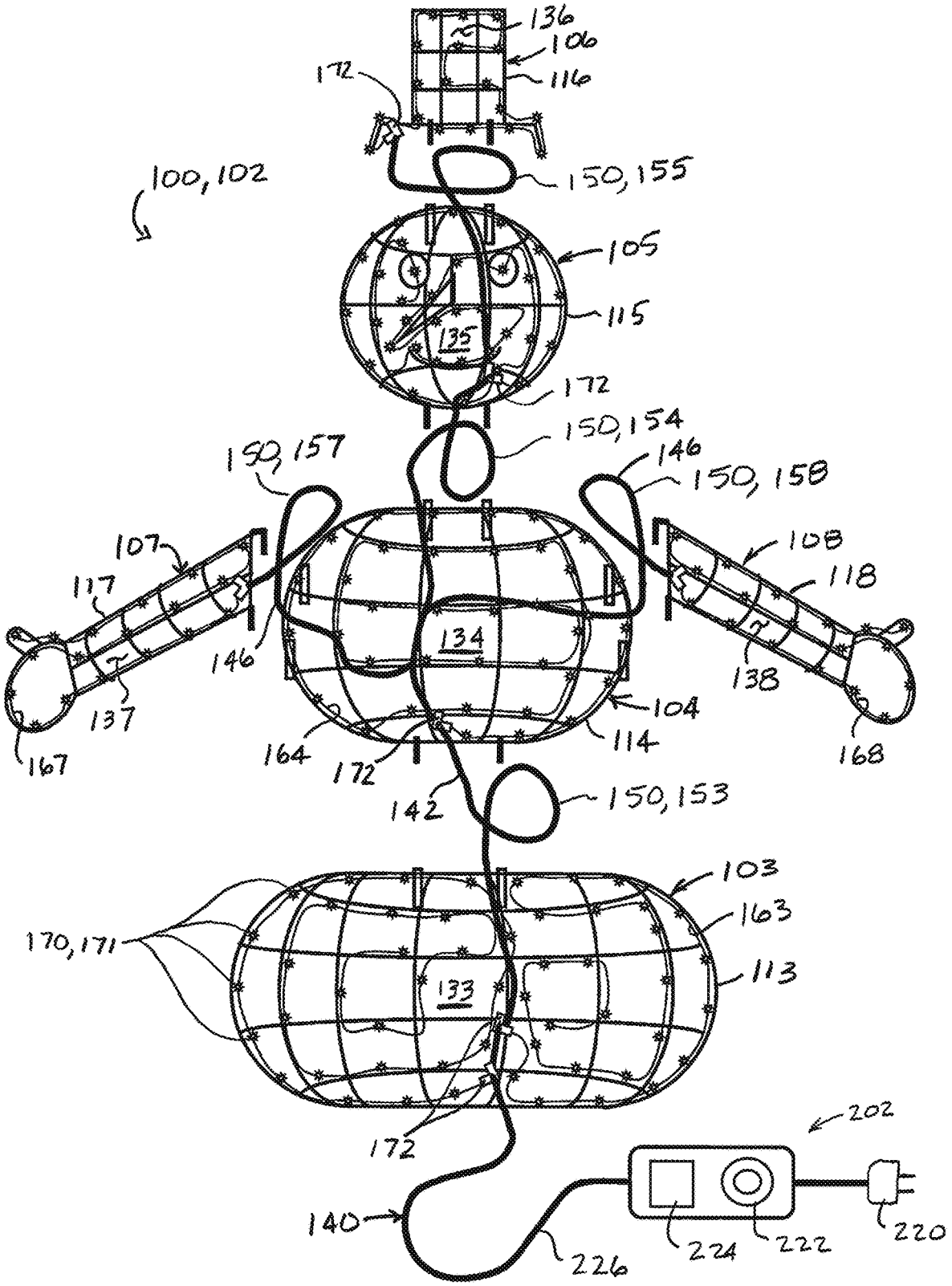
FIG. 3 is a disassembled view of the lighted decorative sculpture of FIG. 1 in an embodiment of the disclosure.
Figure 4:
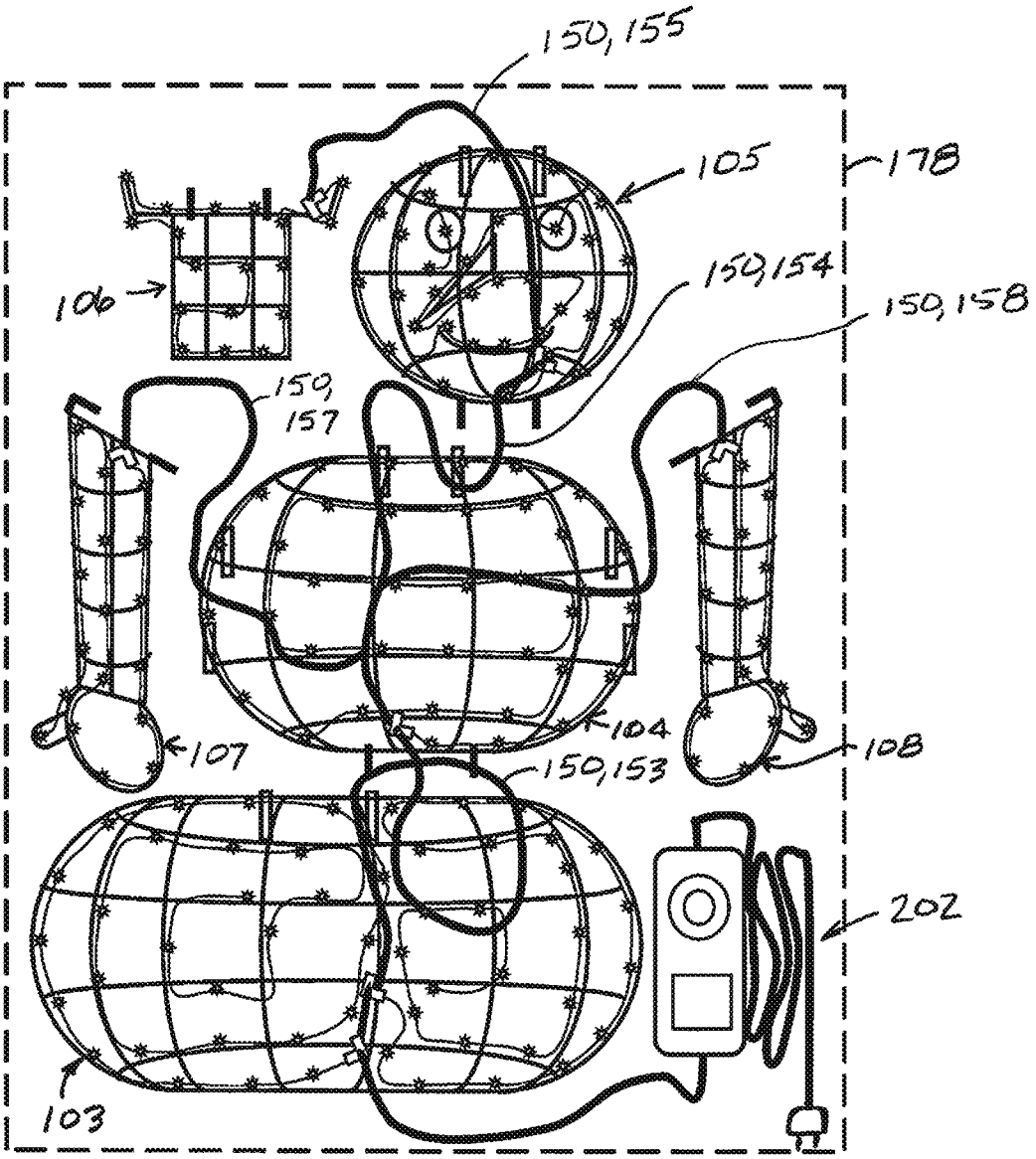
FIG. 4 is the disassembled lighted decorative sculpture of FIG. 3 crated for shipping or storage in an embodiment of the disclosure.

Referring to FIGS. 2 through 4, the lighted decorative sculpture 100 is depicted in various stages of assembly and storage in embodiments of the disclosure. In the depicted embodiment, the detachable sections 103-108 each include an open framework 113-118, respectively, that define a respective component of the lighted decorative structure 100 (FIG. 2). The open frameworks 113-118 include mechanical mounting fixtures 120, for example pins 122 that mount within sockets 124 as depicted (FIG. 2). In some embodiments, the mounting fixtures 120 are keyed, for example, by virtue of their location on the respective open framework 113-118 in three-dimensional space, or, for example, by the shape of the pins 122 and sockets 124 (e.g., square or rectangular), so that the respective detachable section 103-108 can only be mounted to each other in the proper orientation. The open frameworks 113-118 and mounting fixtures 120 may be fabricated from a metal material, though other materials may be utilized, including plastic. In the depicted embodiment, each of the open frameworks 113-118 define a respective interior 133-138.

Figure 6:
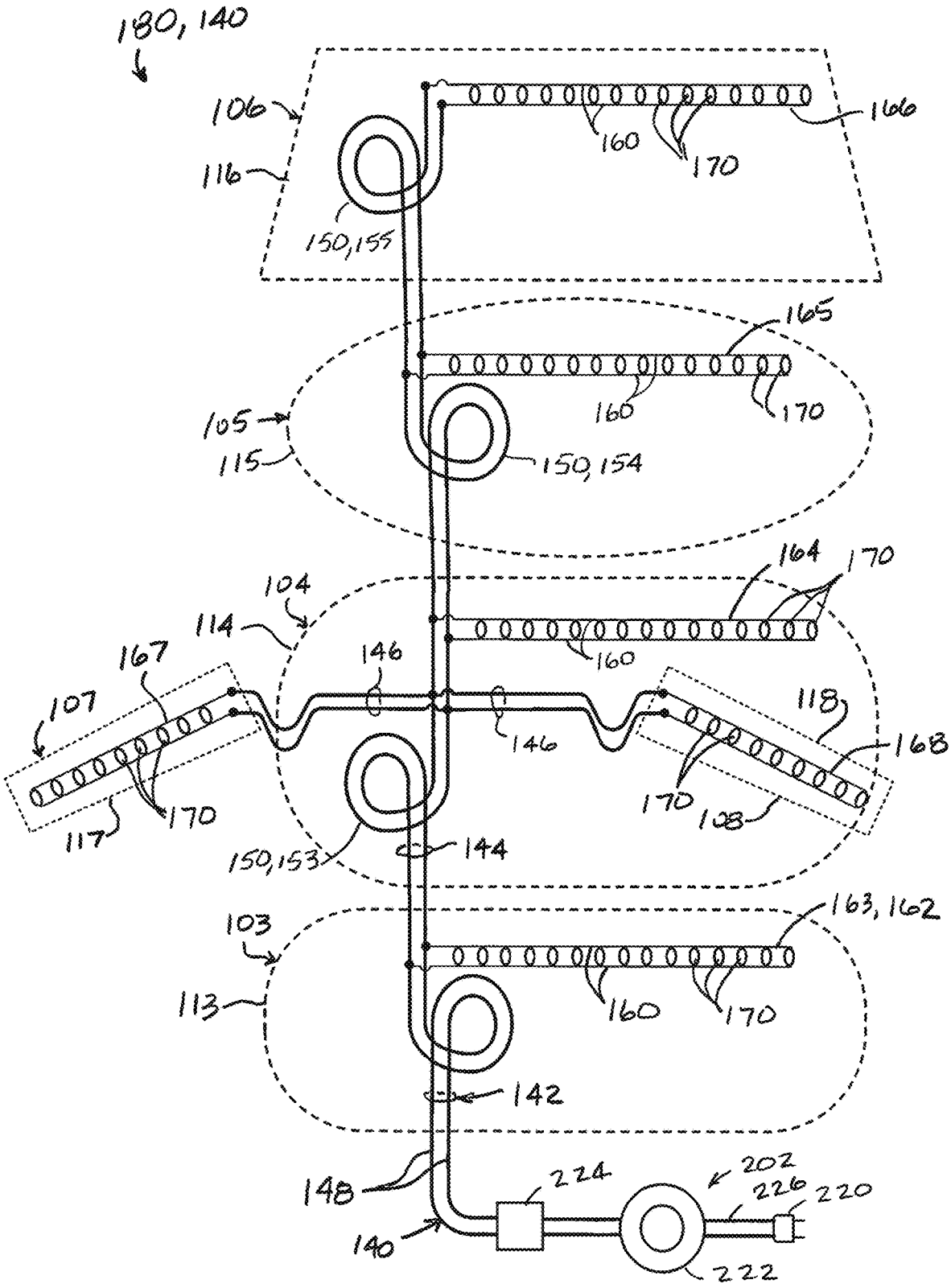
FIG. 6 is a schematic of a lighting system in an embodiment of the disclosure.

The lighted decorative sculpture 100 includes a lighting system 140 (FIG. 3). The lighting system 140 includes a main power circuit 142 that is routed through the open frameworks 113-118. In the depicted embodiment, the main power circuit 142 includes a trunk portion 144 that extends through the open frameworks 113-116 that are arranged in sequence along axis A, and branch portions 146 that extend laterally from the trunk portions 144 to open frameworks 117 and 118. The main power circuit 142 may be routed within the interiors 133-136 of the open frameworks 113-116, and mounted to the structure of the open frameworks 113-116, for example with cable ties, twist ties, chord clips, or other mounting appurtenances available to the artisan. In an embodiment, the main power circuit 142 includes a pair of parallel wires 148 (FIG. 6). In an embodiment, each of the pair of wires of main power circuit 142 comprises a continuous, unbroken wire, as depicted. In another embodiment, main power circuit 142 each of the pair of parallel wires comprises a plurality of wire segments electrically connected together, such as end-to-end, to form a continuous conductive path comprised of several wire segments (as opposed to a continuous wire). Each wire includes a conductor portion surrounded by an insulative portion.

In some embodiments, the main power circuit 142 is characterized as having excess lengths 150 of power line (FIG. 3) that extend between the detachable sections 103-108. That is: an excess length 153 extends between detachable sections 103 and 104; an excess length 154 extends between detachable sections 104 and 105; an excess length 155 extends between detachable sections 105 and 106; an excess length 155 extends between detachable sections 105 and 106; an excess length 157 extends between detachable sections 104 and 107; and an excess length 158 extends between detachable sections 104 and 108. As depicted, excess lengths 150, including 153-158 comprise portions of wires of main power circuit 142 that in an embodiment, do not include any light-string connectors or lights. In an embodiment, a length of an excess length 150 may be defined by the length of the portion of wire extending from a point of attachment to one framework to a point of attachment to another framework. During assembly of the lighted decorative sculpture 100, the excess lengths 150 may be disposed within the interiors 133-138 of the open frameworks 113-118.

Figure 5:
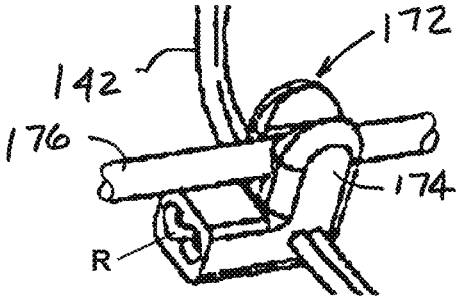
FIG. 5 is an enlarged, perspective view of a connector mounted to an open framework in an embodiment of the disclosure.

Each of the detachable sections 103-108 includes at least one respective light string 162-168. Note that in the depicted embodiment, detachable section 103 includes two light strings 162 and 163. The light strings 162-166 branch off the trunk portion 144, and light strings 167 and 168 extend from the branch portions 147 and 148, respectively. The light strings 162-168 may be routed within the interiors 133-138 of the open frameworks 113-118, and mounted to the structure of the open frameworks 113-118, for example with cable ties, twist ties, chord clips, or other mounting appurtenances available to the artisan. The light strings 162-168 each include parallel wires 160 electrically bridged by a plurality of lights 170, such that lights 170 are electrically connected to one another in parallel. In some embodiments, groups of lights 170 are electrically connected to one another in parallel, and multiple groups of lights 170 are electrically connected to one another in series. The light strings 162-168 may be coupled to the main power circuit 142 with connectors 172. In some embodiments, the connector 172 includes a clip structure 174 for clipping to framework members 176 of the open frameworks 113-118 (FIG. 5). In an embodiment, clip 172 defines a light-string receiving portion R for receiving one of light strings 162-168, including an end clip 305 of a light string, as described further below.

In some embodiments, the wires 160 of the light strings 162-168 are of a lighter gauge than the wires 148 of the main power circuit 142, and therefore have a lower current-carrying capacity and a smaller conductor cross-sectional diameter. For example, in some embodiments, the gauge of the wires 160 of the light strings 162-168 are in a range of 24 AWG (American Wire Gauge) to 30 AWG inclusive, whereas the gauge of the wires 148 of the main power circuit 142 are in a range of 18 AWG to 22 AWG inclusive. (Herein, a range that is said to be "inclusive" includes the end point values of the stated range as well as any values between the end point values.)

Functionally, the excess lengths 150 of the main power circuit 142 enable the detachable sections 103-108 to be separated and positioned, for example, for shipping or storage within a container 178 (FIG. 4) without imparting excessive stress on the main power circuit 142, the light strings 162-168, or the open frameworks 113-118. The heavier gauge of the wires of the main power circuit 142 enables the main power circuit 120 to be flexed during assembly and disassembly of the lighted decorative sculpture 100 without being damaged, while the lighter smaller gauge wires of the light strings 162-168 remain immobile and substantially free of flexing within the detachable sections 103-108.

Referring to FIG. 6, a schematic 180 of the lighting system 140 is depicted in an embodiment of the disclosure. The schematic 180 identifies the components discussed attendant to FIGS. 1-4 with same-numbered numerical references. For the sake of illustration, open frameworks 113-118 of respective detachable sections 103-108 are depicted in dashed lines to suggest the relative placement of portions of the lighting system 140.

Generally, the lighting system 140 transmits electrical power from an external power source to light strings 162-168 and lights 170. Transmission of power to light strings 162-168 may be selective in that power to light strings 162-168 or lights 170 is selectively turned on and off, including for basic on/off functions as well as more sophisticated control functions, such as twinkling, color-changing, flashing, and so on. The lighting system 140 may also transmit communication signals to portions of the lighted decorative sculpture 100, including to light strings 162-168. The lights 170 may generally comprise LEDs 171, but in some embodiments, may comprise incandescent lamps. The LEDs 171 may comprise an assembly with an LED chip having a diode, the light-emitting diode may be on a package or substrate, and includes an anode and cathode portion. In some embodiments, the LEDs 171 may comprise multiple LEDs, such as a red-green-blue (RGB) LED chip. In some assemblies, one or more LEDs 171 may comprise a "twinkling" LED, wherein an LED assembly includes electronics causing the LED 171 to periodically turn on and off. In an embodiment, one or more of the light strings 162-168 include all non-twinkling LEDs; in another embodiment, one or more of the light strings 162-168 include one or more twinkling LEDs, and in one such embodiment, the lighted decorative sculpture 100 includes twinkling LEDs that comprise less than 10% or less than 5% twinkling LEDs, depending on the desired effect. Twinkling LEDs may be employed without a central control device.

As also depicted in FIGS. 1, 3, and 4, an input power portion 202 includes power plug 220, optional switch 222, optional controller 224 and input power wiring 226. The power plug 220 is configured to be connected to an external source of power, which may comprise a 120V alternating-current (AC) power source. Optional switch 222 may comprise a switch configured to selectively allow power or communication signals to be transmitted through tree lighting system 200. Optional controller 224 may comprise a controller, microprocessor or other control device for controlling power and/or communication signals. In an embodiment, switch 222 and controller 224 may be combined. In some embodiments, the lighting system 140 may also include power-conditioning circuitry, such as an electrical transformer or other such known electrical componentry for lowering or converting input voltage. In various embodiments, such power-conditioning circuitry includes an AC-DC (direct current) circuit, which may include a transformer. In another embodiment, such power-conditioning circuitry includes and AC-AC circuit for lowering incoming AC voltage to a voltage appropriate for the electronics, including light strings 162-168 of the lighted decorative sculpture 100. In some embodiments, such power-conditioning circuitry may be integrated into power plug 220, or may be included with switch 222 and/or controller 224, or may be located elsewhere on, in or about the lighted decorative sculpture 100.

Input wiring 226 comprises at least two insulated conductors. Each conductor may comprises a plurality of conductor strands, as is known and understood by those of ordinary skill. Herein, "conductor" is mean to include conductors that may comprise a plurality of conductor strands, or a single conductor strand, unless specifically indicated to the contrary. Input wiring 226 may include any or all wiring connecting power plug 220 to the lighted decorative sculpture 100, including wires external thereto. In some embodiments, the wires 148 of the main power circuit 142 include insulated conductors, and are electrically connected to the power plug 220 and the connectors 172.

In some embodiments, the main power circuit 142 implements trunk connectors or other connectors (not depicted) instead of or in addition to the excess lengths 150. Such trunk connectors are disclosed in U.S. Pat. No. 8,454,186 to Chen, entitled "Modular Lighted Tree with Trunk Electrical Connectors", U.S. Patent Pub. No. 2013/0308301 to Chen, entitled "Modular Tree with Locking Trunk and Locking Electrical Connectors", U.S. Pat. No. 9,044,056 to Chen, entitled "Modular Tree with Electrical Connector", U.S. Pat. No. 9,179,793 to Chen, entitled "Modular Tree with Rotation-Lock Electrical Connectors", U.S. Patent Pub. No. 2014/0287618, entitled Modular Tree with Locking Trunk and Locking Electrical Connectors", U.S. Pat. Pub. No. US 2014/0268689 to Chen, entitled "Modular Tree with Trunk Connectors", and U.S. Provisional Patent Application No. 62/377,848 to Chen, filed Aug. 22, 2016 and entitled "Artificial Tree with LED-Based Lighting Systems", all of the disclosures of which are incorporated by reference herein in their entireties, except for express definitions and patent claims contained therein.

In various embodiments, the number of lights 170 or LEDs 171 per light string 162-168 varies. Generally, for detachable sections 103-108 of lighted decorative sculpture 100 of relatively large size, for example, detachable section 103 being the base of the snowman 102, the light strings 162 and 163 may be generally longer, and include more lights 170; for detachable sections 103-108 of lighted decorative sculpture 100 of relatively smaller size, such as detachable section 105, may have a shorter length with fewer lights 170.

As will be described further below, each light string 162-168 includes a plurality of lights 170 or LEDs 171, parallel wires 160, and a light string connector portion 305. A light-set connector portion 305 may form a distinct connector. Each light string connector portion 305 is configured to couple to a respective one of the connectors 172 to mechanically and electrically connect a light string 162-168 to the main power circuit 142. In an embodiment, each of parallel wires 160 comprise a single-strand conductor. In other embodiments, the parallel wires 160 include multi-strand conductors.

Referring to FIGS. 7-11, several embodiments of light strings 162-168 are depicted.

Figure 7:
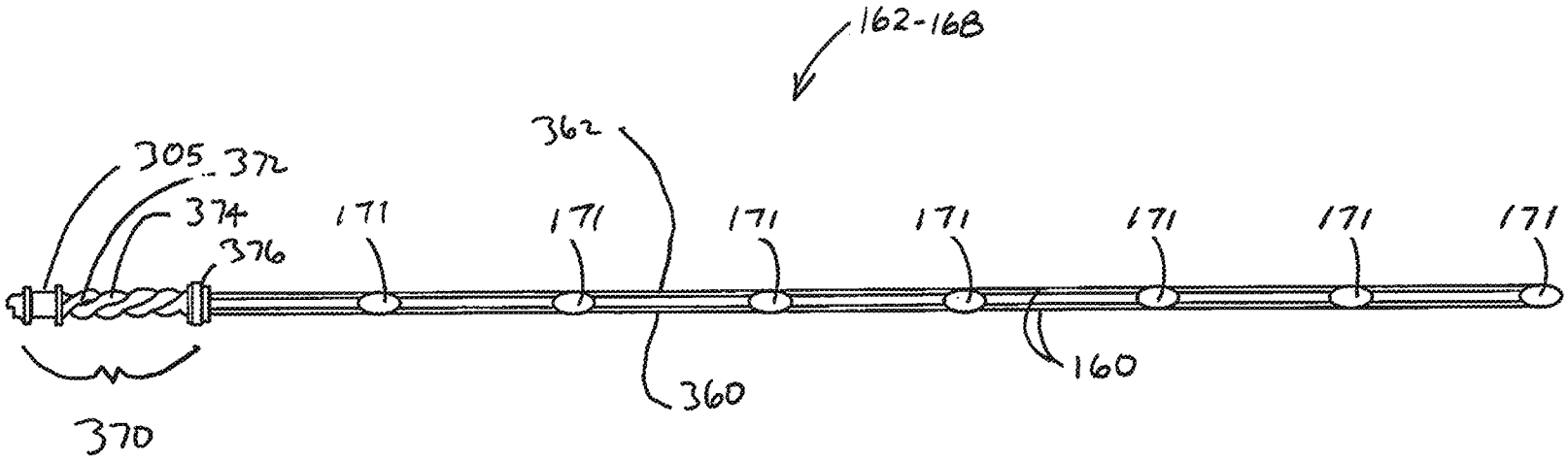
FIGS. 7-11 present various configurations of light strings in embodiments of the disclosure.

Referring specifically to FIG. 7, an embodiment of the light strings 162-168 is depicted. In this embodiment, the light strings 162-168 include a connector system 370, parallel wires 160 of individual wires 360 and 362, and a plurality of LEDs 171. In the embodiment depicted, the light strings 162-168 include six LEDs 171, but it will be understood that the light strings 162-168 may include fewer or more LEDs 110 as described above. In an embodiment, wire 360 conducts electricity having a first polarity, such as a positive DC voltage, and wire 362 conducts electricity having a second polarity, such as a negative DC voltage. In a parallel-connected embodiment, an anode of an LED 171 is connected to one of the parallel wires, and a cathode of the LED 171 is connected to the other of the parallel wires.

In an embodiment, each of wires 360 and 362 comprise a single strand conductor coated with an insulating material. Such single strand conductors are known in the industry as enameled wire or "magnet" wire, often used for windings in electromagnets, transformers, and so on. In embodiments, wires 360 and 362 may comprise a copper or aluminum material, or a metal alloy comprising any of copper, aluminum, nickel, steel, and others. As will be understood by those familiar with magnet wire, the wire tends to be very brittle and easily broken. However, due to the protective design features of the lighted decorative sculpture 100, single-strand conductors, including magnet wire, may be used in the light strings 162-168 without significant risk of breakage.

Figure 8A:
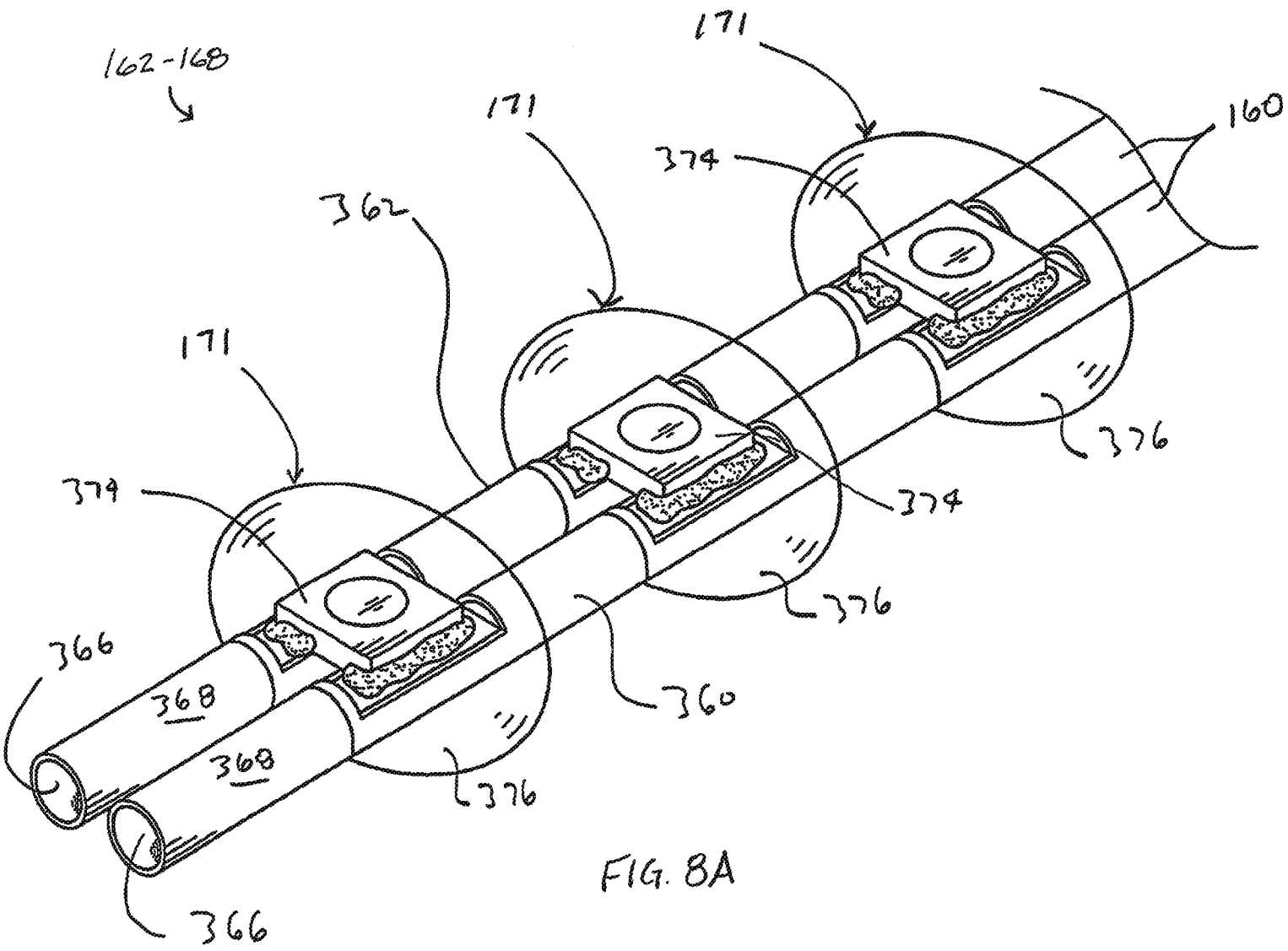

Referring also to FIG. 8A, an embodiment of a portion of the light strings 162-168 of FIG. 7 is depicted. In this embodiment, each of the parallel wires 160 include a single-strand conductor 366 coated with an electrically insulative coating 368. Insulative coating 368 may comprises any of known insulative coatings or materials, including the enamel coating of a magnet wire, mentioned above, as well as known PVC insulative materials. In an embodiment, wires 360 and 362 are each continuous wires extending from one end to another end of the light strings 162-168, connecting each of LEDs 171, rather than each comprising a plurality of wire segments between each LED 171. LEDs 171 each comprise an assembly that may include an LED chip 374, which may be a surface-mount LED chip as depicted. LED chip 374 is electrically connected to conductors 366. A layer of epoxy or other translucent, transmissive or similar material 376 covers or encapsulates each LED 171, forming a protective layer around each LED chip 374 and its connections to conductors 366. Epoxy layer 376 also forms a lens for LED 171. Similar constructions are known in the art and described in U.S. Pat. No. 7,926,978 to Tsai, entitled "Light Set with Surface Mounted Light Emitting Components", which is hereby incorporated by reference herein in its entirety except for express definitions and patent claims contained therein.

In an embodiment, the light strings 162-168 may be manufactured from a very long, continuous set of lights comprising wires 360, 362 and LEDs 171. In such an embodiment, the spacing between LEDs 171 is uniform, and portions of the continuous light set are cut to a desired length or LED count from the longer, continuous set of lights as part of the manufacturing process.

It will be understood that although embodiments of wires 360 and 362 include single-strand conductors, such as magnet wire, other embodiments of wires 360 and 362 may include more traditional wire types, including multi-strand wires, though generally in a smaller gauge as compared to traditional light sets.

In the embodiment depicted, the light strings 162-168 includes a transitional connector system 370 for connecting the magnet-wire portion or thin wire portion of the light strings 162-168 to a detachable section wiring portion, such as one of the detachable sections 103-108. In the embodiment depicted connector system includes connector 172, the parallel wires 160 that includes insulated conductor wires 372 and 374, and a connector 376. In an embodiment, and as depicted, wires 372 and 374 may comprise traditional insulated wires, such as 22 or 25 AWG or other gauge CXTW wires.

In an embodiment of the disclosure, connector 305 is configured to couple to connector 172 of the main power circuit 142, thereby making a mechanical and electrical connection between the light strings 162-168 and the main power circuit 142. In an embodiment, connector 305 may comprise any of many known connectors that include plastic body portions and multiple electrical terminals that make an electrical connection with conductors of insulated wires.

In an embodiment, "connector" 376 may comprise a traditional known connector such as connector 305, but modified to handle the smaller size of wires 362; alternatively, connector 376 may include a "connection system", that includes a soldered connection between wires 372 and 360 and between wires 374 and 362, each soldered connection covered by an electrically insulative sleeve, such as a "shrink wrap" sleeve as is known in the industry. Consequently, connector 376 provides a connection between a pair of wires 360, 362 having a small conductive diameter, and two larger wires of a different type, wires 372, 374.

Figure 8B:
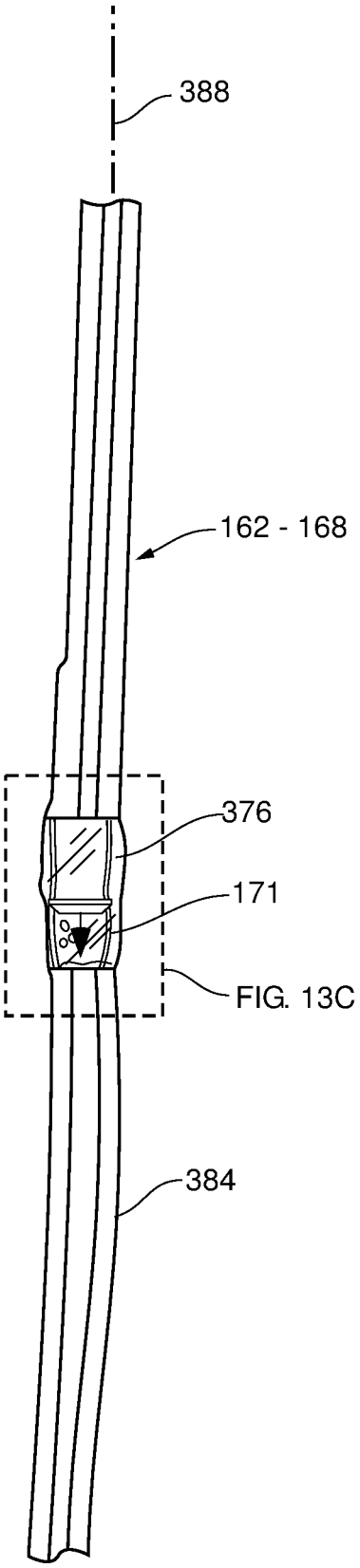
Figure 8C:
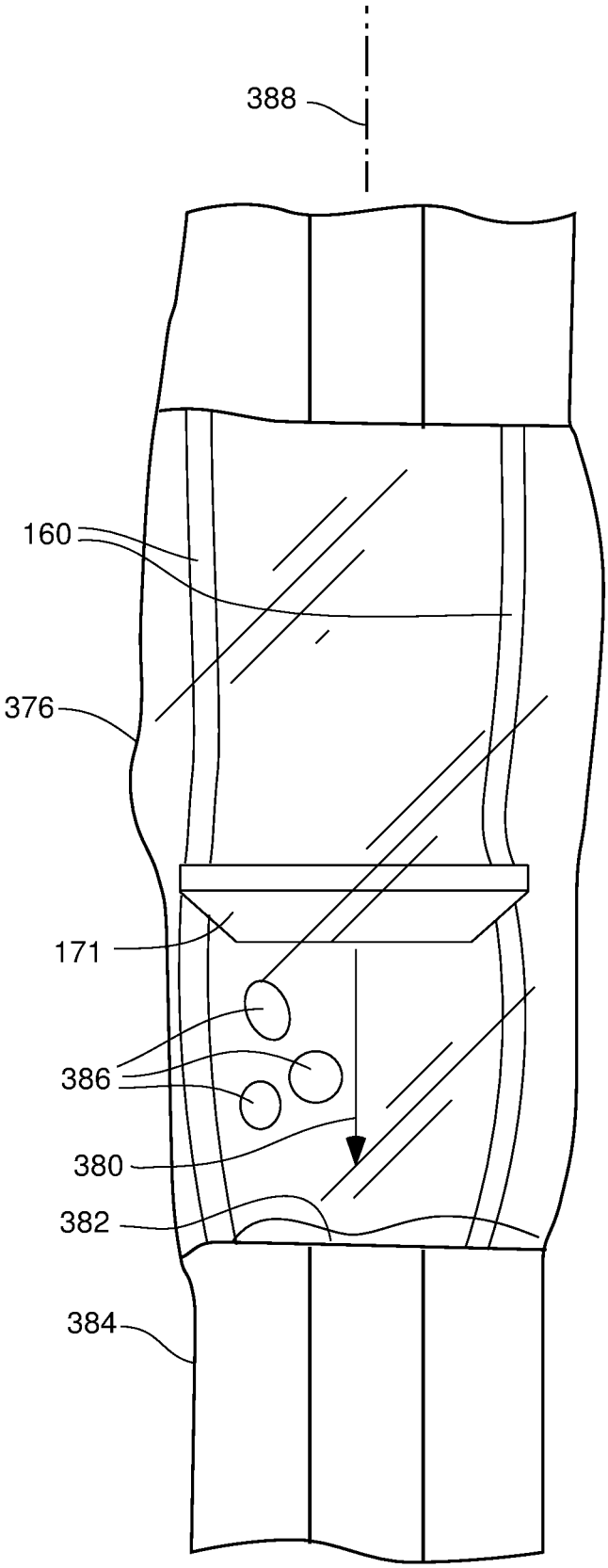

Referring to FIGS. 8B and 8C, an alternative orientation for the LEDs 171 is depicted in an embodiment of the disclosure. In this embodiment, the LEDs 171 are oriented so that a maximum intensity 380 of the light emitted by the LED 171 is substantially parallel to the parallel wires 160 of the light string 162-168. That is, the LED 171 effectively irradiates an end 382 of electrical insulation 384 that is exposed for connection of the LED 171 to the parallel wires 160. The LED 171 may be connected to the parallel wires 160 using techniques described above or otherwise available to the artisan. The LED 171, exposed portions of the parallel wires 160, and exposed ends of the electrical insulation 384 are then encapsulated, for example in the epoxy or other translucent, transmissive or similar material 376. In some embodiments, the material 376 may define voids 386.

In operation, the LED 171 oriented as depicted in FIGS. 8B and 8C tends to distribute the light emitted by the LED 171 about a longitudinal axis 388 of the light string 162-168. The encapsulation material 376 helps to diffuse, scatter, and refract the emitted light away from the longitudinal axis 388. The distributed emission is in contrast to the orientation of the LEDs 171 depicted in FIG. 8A, which emit light strongly in one lateral direction from the direction of the maximum intensity 380 and away from the longitudinal axis 388 of the light string 162-168. The voids 386 can also enhance the diffusion, scattering, and refraction of light away from the longitudinal axis 388 of the light string 162-168. Functionally, the arrangement of FIGS. 8B and 8C will tend to make the lighting effect of the lighting strings 162-168 more uniform, regardless of the direction from which the lighted decorative sculpture 100 is viewed.

Figure 9:
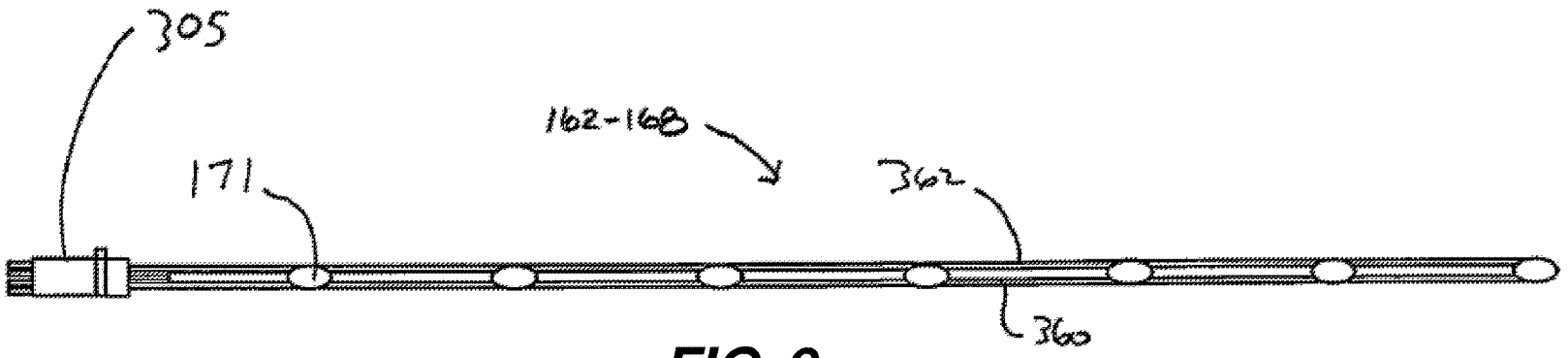

Referring to FIG. 9, another embodiment of the light strings 162-168 is depicted. In this embodiment, the connector 172 is directly coupled to wires 360 and 362 of the light strings 162-168. Unlike the light strings 162-168 of FIG. 7, the light strings 162-168 of FIG. 9 do not require the transitional connector system 370, but rather, a mechanical connection is made between electrical terminals inside connector 172 and end portions of wires 360 and 362, thereby also making an electrical connection between wires. Such a mechanical connection avoids the traditional method of soldering wires of disparate sizes together. An embodiment of connector 305 is depicted in FIGS. 12-21, and described further below.

Figure 10:
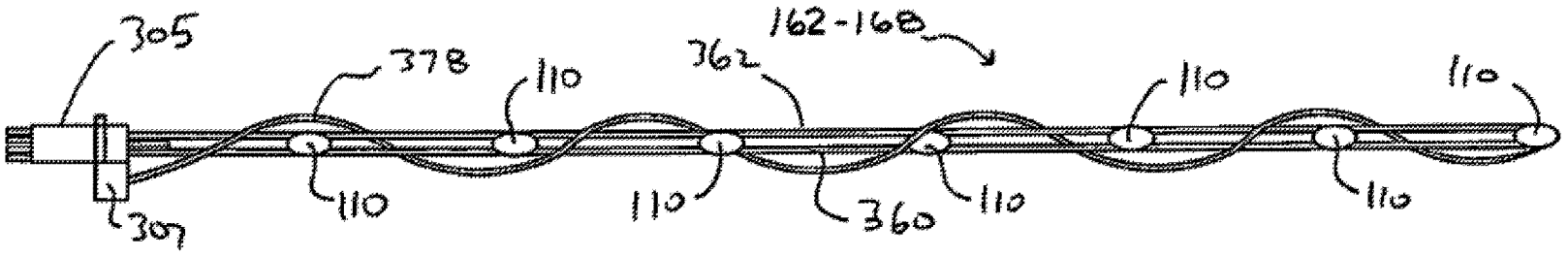
Figure 11:
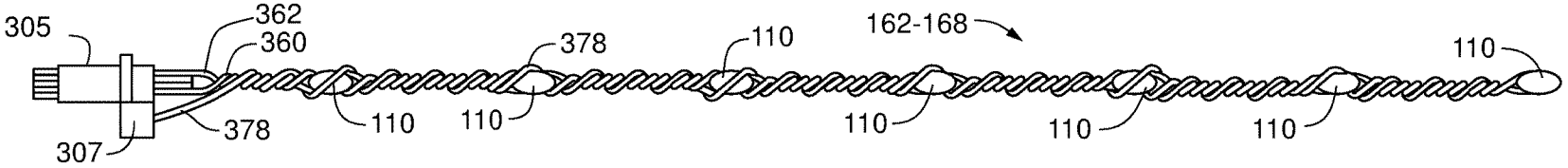

Referring to FIGS. 10 and 11, additional embodiments of the light strings 162-168 are depicted. The light strings 162-168 of FIGS. 10 and 11 are similar to the light strings 162-168 of FIG. 7, except that the light strings 162-168 of FIGS. 10 and 11 include a reinforcing or supporting strand wrapped about conductors 360 and 362. Connector 305 also includes additional structure for anchoring an end of a segment of a reinforcing or supporting strand 378.

In an embodiment, and as depicted, reinforcing strand 378 is anchored to connector 305 and an end, then wrapped about conductors 360 and 362. In the embodiment of FIG. 10, conductors 360 and 362 are generally not twisted about one another in the embodiment depicted. Supporting strand 378 adds to the strength of the light strings 162-168 with respect to any longitudinal pulling force that might accidentally be applied to the relatively small diameter wires 360 and 362. Such pulling force might be the result of a user tugging on the light strings 162-168 while attached to a branch 160. The use of a reinforcing or supporting strand 378 may be more useful as the conductor diameter of wires 360 and 362 decrease, and in particular, when single-strand, small conductor size magnet wires are used.

In the embodiment depicted in FIG. 11, not only is supporting strand 378 twisted about conductors 360 and 362, but conductors 360 and 362 are also twisted about one another.

In an alternate embodiment, a reinforcing or supporting strand 378 may be integrated into a wire 360 and/or a wire 362. In one such embodiment, one or more strands 378 may be intertwined with, or wrapped about, conductors 366, with insulating material covering both the reinforcing strand and the conductors. Embodiments of wires with integrated reinforcing strands are further described in U.S. Pat. No. 9,243,788 to Chen, entitled "Decorative Lighting with Reinforced Wiring", which is incorporated by reference herein in its entirety except for express definitions and patent claims contained therein.

Referring to FIGS. 12-21, an embodiment of an alternative connector 400/402 is depicted. As described above, the light strings 162-168 are connected the main power circuit 142 via a pair of connectors 172 and 305. Connectors 400 and 402 may be considered "separate" connectors, or two halves of a connector, but in any case, serve to make an electrical and mechanical connection between the light strings 162-168 and the main power circuit 142.

In the embodiment depicted in FIGS. 12-21, the connector 400/402 combines the functionality of previously described connectors 172 and 305, making a mechanical and electrical connection between the wires of the light strings 162-168 and the parallel wires 148 of the main power circuit 142. In the embodiment depicted, connector 400/402 makes a connection between wires of disparate sizes, both in terms of overall diameter (a diameter that includes insulation) and in terms of conductor diameter. In an embodiment, and as depicted, the light strings 162-168 includes relatively thin single strand wires 360 and 362, which in an embodiment comprise magnet wires. In an embodiment, and also as depicted, wires 300 of first section wiring portion 206 comprise insulated conductors, each conductor comprising multiple conductor strands, and having both an overall wire diameter greater than either of wires 360 and 362, and also having a conductor diameter (combined conductor strands) that is greater than either of the conductors of wires 360 and 362 (conductors 366—see, FIG. 8A).

Embodiments of the light strings 162-168 connected to connectors 400/402 facilitate the easy replacement of a single light string 162-168, without having to replace other the light strings 162-168, and without having to remove or replace one of the detachable sections 203-208.

Connector 400/402 provides a solution to the difficulty of mechanically connecting (and thereby electrically connecting) wires of different sizes, and avoids the need to solder wires of the light strings 162-168 to the pair of wires 148 of the main power circuit 142. Consequently, connector 400/402 herein may also be referred to as a disparate-wire-size connector or connector system 400/402.

Furthermore, as depicted, connector 400/402 may also include a support-strand anchor portion, such as anchor support portion 307. However, it will be understood that embodiments of connector system 400/402 may be fabricated sans a support-strand anchor portion.

Figure 12:
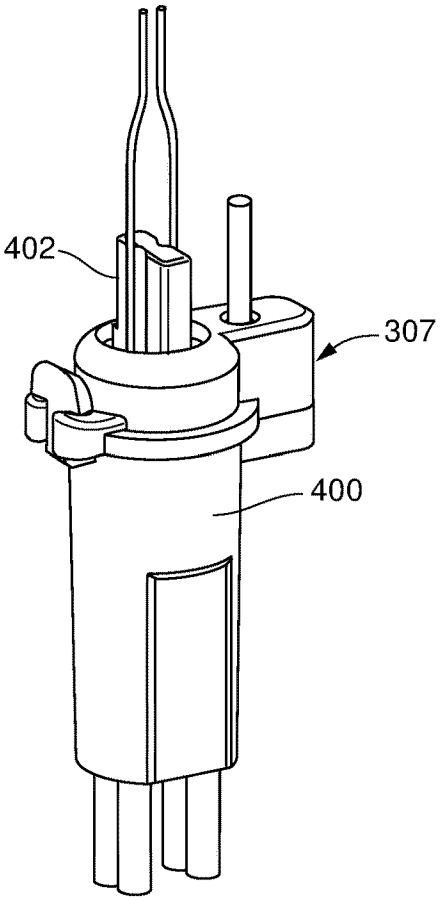

Referring specifically to FIG. 12, an assembled depiction of connector system 400/402 is provided. In an embodiment, connector system 400/402 includes body portion 400, which may also be referred to as a large-wire receiver or holder, and insert 402, which may also be referred to as a small-wire receiver or holder.

Referring also to FIG. 13, in an embodiment, body portion 400 is configured to receive two conductive electrical terminals 404 and 406. Terminal 404, in an embodiment, is mechanically and electrically connected to one or more wires, such as wires 160. In the embodiment depicted, terminal 404 is connected to two wires 300*c*, and terminal 406 is connected to two wires 300*d*. Such a configuration may be used when multiple connectors 400/402 are connected in parallel. In other embodiments, terminal 404 may be connected to only one wire, and/or terminal 406 may be connected to only one wire. When multiple connectors 400/402 are connected in series, terminals 404 and 406 may collectively connect to three wires.

Referring also to FIG. 14, terminals 404 and 406 are inserted into body portion 400, and a portion of each of wires 300*c* and 300*d* are received into body portion 400.

In an embodiment, body portion 400 comprises a generally cylindrical shape, defining interior cavity 410. In an embodiment, body portion 400 may also include pivoting locking tab 412 and anchor tab 414.

Referring to FIG. 15, insert 402, the wires 160 of the light strings 162-168, and optional support strand 378 is depicted, prior to assembly.

In an embodiment, insert 402 includes optional support-strand anchor portion 307, body portion 420, first projecting portion 422, second projecting portion 424, and optional locking tab receiver 426.

In an embodiment, first projecting portion 422, in an embodiment, forms a portion of body 420 and projects axially away from body portion 420, and defines one or more wire-receiving channels 430 for receiving a portion of wires 300*c* and 300*d*, for example, two channels 430 opposite one another (only one depicted in FIG. 15).

Second projecting portion, in an embodiment, also forms a portion of body portion 420, though in other embodiments, comprises a separately-manufactured, or non-integral part. Second projection 422 extends axially away from body portion, and may define one or more wire-receiving channels 440 for receiving wires 360 and 362, for example, two channels 440, opposite one another (only one depicted in FIG. 15).

In an embodiment, body portion 420 includes circumferential flange or ring 450, and in an embodiment, defines interior channels or openings 460 through which ends of wires 360 and 362 project. In an embodiment, ends of wires 360 and 362 are "tinned", or placed into a metal bath to remove the isolative coating of the wire, and to prepare it for contact with terminals 404 and 406.

Support strand anchor portion 307, when present, forms a tab projecting from body portion 420, and may define support-strand hole 309 for receiving a portion of support strand 378.

Referring also to FIG. 16, insert 402 assembled to wires 360 and 362, as well as support strand 378 is depicted.

Figure 17:
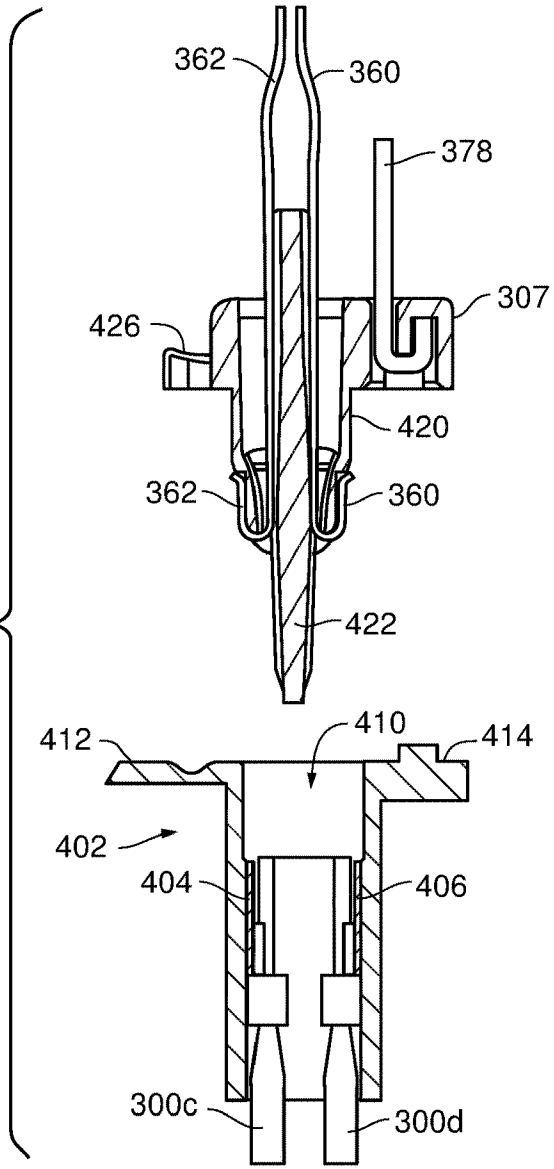
Figure 18:
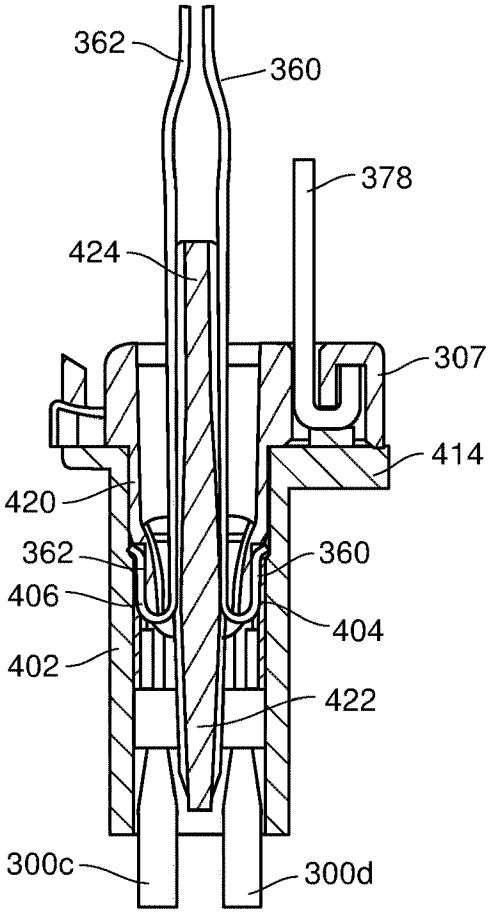

Referring to FIGS. 17 and 18, a sectional depiction of insert 402 with wires, and a sectional depiction of body portion 400 with wires, unassembled and assembled, respectively, are depicted. In an embodiment, and as depicted, projection portion 422 and projection portion 424 form a single component. Further, when assembled, a portion of body portion 420 and projection portion 422 project into cavity 410 of body portion 402, to fit between wires 300*c* and 300*d*. Ends of wires 360 and 362 mechanically contact portions of terminals 406 and 404, respectively, thereby making an electrical connection between wires 300*c*, terminal 406 and wire 362, and also making an electrical connection between wires 300*d*, terminal 404, and wire 360.

Support strand 378 is threaded into the multiple cavities of hole 450; support-strand anchor portion 307 is fitted adjacent to portion 414. In an embodiment, a projection on portion 414 is tightly fitted into a portion of hole 450 of anchor portion 307.

Figure 21:
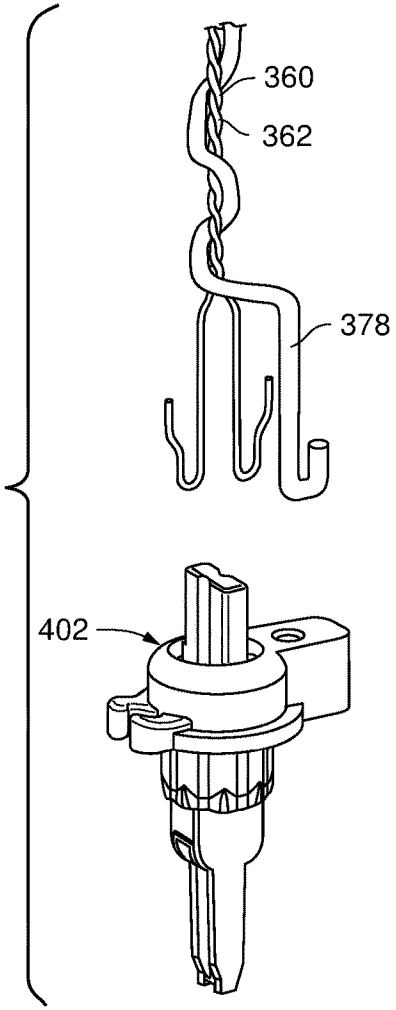
Figure 20:
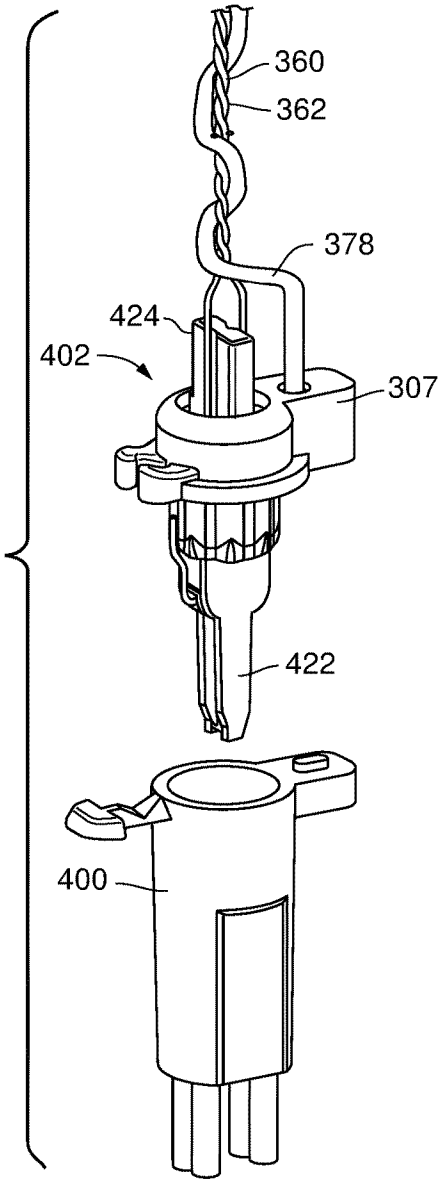
Figure 19:
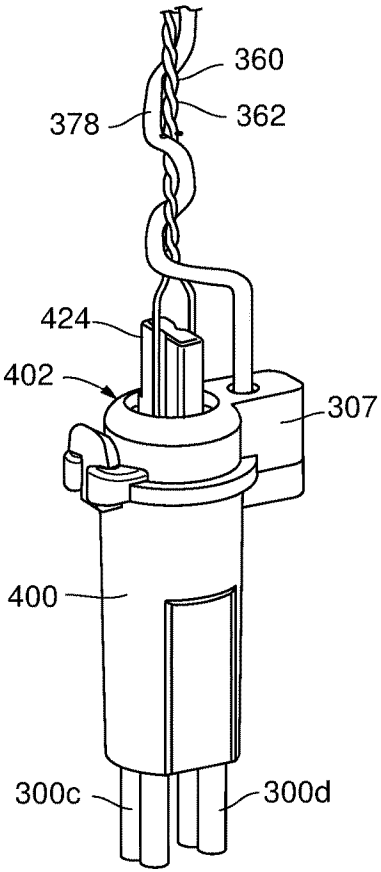

Referring also to FIGS. 19-21, an embodiment of connector system 400/402 is depicted. In this embodiment, all components are substantially the same as those described in FIGS. 19-25, with the exception that wires 360, 362 are twisted together, and support strand 378 is twisted about twisted wires 360 and 362.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, and to enable others of ordinary skill in the art to understand the embodiments disclosed herein.

What is claimed is:

1. A lighted decorative sculpture, comprising:

a plurality of sculpture sections, each including:

an open framework that defines a component of the lighted decorative structure; and a light string of light emitting diodes (LEDs) attached to said open framework, said light string including a pair of parallel wires electrically connecting said LEDs in parallel, said pair of wires each being of a first gauge; and a main power circuit that passes through each of said plurality of detachable sections, said main power circuit including a pair of power wires of a second gauge, said second gauge being higher than said first gauge, wherein said pair of parallel wires of each of said light string of LEDs of each of said plurality of sections are connected to said pair of wires of said main power circuit, and said open frameworks of said plurality of sculpture sections are detachably connected to one another.

2. The lighted decorative sculpture of claim 1, wherein said light string of LEDs of each of said plurality of sculpture sections is attached to said open framework at anchoring locations along said light string of LEDs.

3. The lighted decorative sculpture of claim 1, wherein each of said plurality of sculpture sections is three-dimensional.

4. The lighted decorative sculpture of claim 1, wherein said main power circuit includes excess length that permits said open frameworks of said plurality of detachable sections to be detached and arranged for storage or shipping.

5. The lighted decorative sculpture of claim 4, wherein said excess length is disposed within said lighted decorative sculpture when said plurality of sculpture sections are attached to one another.

6. The lighted decorative sculpture of claim 1, wherein said LEDs of said light string of LEDs is oriented to direct a maximum intensity of light emitted from said LEDs in a direction substantially parallel to said parallel wires of said light string of LEDs.

7. The lighted decorative sculpture of claim 1, wherein said light string of LEDs is connected to said main power circuit with a connector.

8. The lighted decorative sculpture of claim 7, wherein said light string of LEDs is replaceable.

9. The lighted decorative sculpture of claim 1, wherein said first gauge is in a range of 24 AWG to 30 AWG inclusive, and said second gauge is in a range of 18 AWG to 22 AWG inclusive.

10. The lighted decorative sculpture of claim 1, wherein said parallel wires of said light string of LEDs are multi-strand wires.

11. The lighted decorative sculpture of claim 1, wherein said lighted decorative sculpture does not include a light string that branches from another light string.

12. A lighted decorative sculpture, comprising:

a first framework;

a second framework configured to be detachably connected to the first framework;

a main power circuit comprising a pair of insulated wires;

a first light string on the first framework and electrically connected to the main power circuit;

a second light string on the second framework and electrically connected to the main power circuit;

each of the first light string and the second light string including:

a pair of parallel wires defining a longitudinal axis that extends parallel to and between said pair of parallel wires, the pair of parallel wires comprising a first wire with a first conductor and a second wire with a second conductor;

a light emitting diode (LED) assembly mechanically and electrically bridging said pair of parallel wires, said LED assembly being disposed between said first wire and said second wire, said LED assembly being oriented to direct a maximum intensity of light emitted from said LED assembly in a direction substantially parallel to said parallel axis, wherein said LED assembly, said first end, said second end, and said pair of parallel wires that extend from said first end to said second end are encapsulated in a translucent material.

13. The light string of claim 12, wherein said parallel wires have conductors that are of a gauge that is in a range of 24 AWG to 30 AWG inclusive.

14. The lighted decorative sculpture of claim 12, wherein each wire of said pair of parallel wires of said light string comprises a conductor having only a single conductive strand.

15. The lighted decorative sculpture of claim 12, wherein each of the pair of insulated wires of the main power circuit comprise larger diameter wires with higher ampacities as compared to either of wires of the pair of parallel wires.

16. The lighted decorative sculpture of claim 15, further comprising a connector removably connecting the pair of insulated wires to the pair of parallel wires.

17. A lighted decorative sculpture, comprising:

a first framework comprising a plurality of intersecting framework portions;

a main power circuit coupled to the first framework and comprising a first power wire with a first power-wire conductor, and a second power wire with a second power-wire conductor, the first power-wire conductor including one or more power-wire conductor strands;

a first light string on the first framework and electrically connected to the main power circuit by a first connector, the first light string including a first light-string wire, a second light-string wire extending in parallel with the first light-string wire, a first plurality of light-emitting diode (LED) assemblies electrically connected in parallel to the first and second light-string wires, and wherein:

the first light-string wire defines a first light-string wire axis and includes a first continuous light-string conductor and first wire insulation, the first wire insulating a first plurality of first sections of the first continuous light-string conductor along the first light-string axis such that first portions of the first continuous light-string conductor between the first plurality of insulated conductor sections are not insulated, the second light-string wire defines a second light-string axis and includes a second continuous light-string conductor and second wire insulation, the second wire insulating a second plurality of sections of the second continuous light-string conductor along the second light-string wire axis such that second portions of the second continuous light-string conductor between the second plurality of insulated conductor sections are not insulated, and each of the LED assemblies is electrically connected to the first wire at one of the first portions of the first continuous light string conductor that is not insulated and is electrically connected to the second wire at one of the second portions of the second continuous light string conductor that is not insulated, and a translucent material encapsulates each of the LED assemblies and the one of the first portions of the first continuous light string conductor that is not insulated and the one of the second portions of the second continuous light string conductor that is not insulated;

wherein a sum of cross-sectional areas of the one or more light-string conductor strands is less than a sum of cross-sectional areas of the one or more power-wire conductor strands, such that the power-wire conductor strands have a current-carrying capacity that is greater than a current-carrying capacity of the one or more light-string conductor strands.

18. The lighted decorative sculpture of claim 17, wherein the one or more light-string conductors strands consist of a single conductor strand.

19. The lighted decorative sculpture of claim 17, wherein the first connector is a solderless connector.

20. The lighted decorative sculpture of claim 17, wherein each of the LED assemblies is located between the first wire and the second wire, and light emitted from each of the LED assemblies is emitted in a direction parallel to the first light-string wire axis and the second light-string wire axis.

* * * * *